US008414741B2

(12) United States Patent
Klerelid et al.

(10) Patent No.: US 8,414,741 B2
(45) Date of Patent: Apr. 9, 2013

(54) TISSUE PAPERMAKING MACHINE AND A METHOD OF MANUFACTURING A TISSUE PAPER WEB

(75) Inventors: Ingvar Klerelid, Karlstad (SE); Ola Thomasson, Rottneros (SE)

(73) Assignee: Metso Paper Sweden AB, Sundsvall (SE)

( * ) Notice: Subject to any disclaimer, the term of this patent is extended or adjusted under 35 U.S.C. 154(b) by 0 days.

(21) Appl. No.: 13/063,700

(22) PCT Filed: Sep. 16, 2009

(86) PCT No.: PCT/SE2009/051033

§ 371 (c)(1),
(2), (4) Date: Apr. 12, 2011

(87) PCT Pub. No.: WO2010/033072

PCT Pub. Date: Mar. 25, 2010

(65) Prior Publication Data

US 2011/0180223 A1 Jul. 28, 2011

Related U.S. Application Data

(60) Provisional application No. 61/097,834, filed on Sep. 17, 2008.

(30) Foreign Application Priority Data

Sep. 17, 2008 (SE) ..... 0801990

(51) Int. Cl.
*D21F 1/66* (2006.01)
*D21F 3/02* (2006.01)
*D21F 9/00* (2006.01)

(52) U.S. Cl.
USPC ..... 162/358.1; 162/289; 162/358.3; 162/361; 162/363; 162/375; 162/900; 162/901

(58) Field of Classification Search ..... 162/289, 162/358.1–358.5, 359.1, 361, 363, 369, 900–901, 162/375
See application file for complete search history.

(56) References Cited

U.S. PATENT DOCUMENTS 3,224,928 A * 12/1965 Lee et al. ..... 162/214
3,470,063 A * 9/1969 Sanford ..... 162/303

(Continued)

FOREIGN PATENT DOCUMENTS

EP 1832679 A1 * 9/2007
GB 2 189 270 A 10/1987

(Continued)

OTHER PUBLICATIONS

International Search Report of corresponding international application No. PCT/SE2009/051033, mailed Jan. 28, 2010.

(Continued)

*Primary Examiner* — Jose A Fortuna
(74) *Attorney, Agent, or Firm* — Alston & Bird, LLP

(57) ABSTRACT

A tissue papermaking machine is described, comprising a wet section and a press section comprising a single press with first and second press elements forming a press nip, and with a press felt running through the press nip in contact with the formed fiber web, whereby the second press element is arranged inside the loop of the press and felt, and a smooth belt runs through the press nip in contact with the formed fiber web, whereby the first press element is arranged inside the loop of the belt, and a transfer roll arranged inside the loop of the belt forming a transfer nip with a drying surface, whereby the smooth belt carries the fiber web between the press nip and the transfer nip. A pre-dewatering device is arranged upstream of the press to dewater the fiber web to a dry content of 15-30%. Associated methods are also provided.

13 Claims, 2 Drawing Sheets

U.S. PATENT DOCUMENTS

| | | | | |
|---|---|---|---|---|
| 3,745,066 | A * | 7/1973 | Bleuer | 162/301 |
| RE28,459 | E * | 7/1975 | Cole et al. | 34/306 |
| 4,738,752 | A * | 4/1988 | Busker et al. | 162/358.5 |
| 5,393,384 | A * | 2/1995 | Steiner et al. | 162/359.1 |
| 5,556,511 | A * | 9/1996 | Bluhm et al. | 162/206 |
| 5,736,011 | A * | 4/1998 | Kade et al. | 162/336 |
| 5,861,082 | A * | 1/1999 | Ampulski et al. | 162/117 |
| 6,004,430 | A * | 12/1999 | Ilvespaa et al. | 162/207 |
| 6,287,426 | B1 | 9/2001 | Edwards et al. | |
| 6,488,816 | B1 * | 12/2002 | Klerelid | 162/359.1 |
| 6,547,924 | B2 * | 4/2003 | Klerelid et al. | 162/109 |
| 6,743,339 | B1 | 6/2004 | Nilsson et al. | |
| 7,887,673 | B2 * | 2/2011 | Andersson et al. | 162/202 |
| 8,202,396 | B2 * | 6/2012 | Hultcrantz et al. | 162/116 |
| 8,206,555 | B2 * | 6/2012 | Klerelid et al. | 162/203 |
| 8,216,427 | B2 * | 7/2012 | Klerelid et al. | 162/358.2 |
| 2002/0060042 | A1 * | 5/2002 | Klerelid et al. | 162/358.1 |
| 2002/0179269 | A1 * | 12/2002 | Klerelid | 162/206 |
| 2008/0236774 | A1 * | 10/2008 | Henssler et al. | 162/175 |
| 2010/0065234 | A1 * | 3/2010 | Klerelid et al. | 162/111 |
| 2010/0139881 | A1 * | 6/2010 | Beuther et al. | 162/206 |
| 2011/0088859 | A1 * | 4/2011 | Hultcrantz et al. | 162/111 |
| 2011/0180223 | A1 * | 7/2011 | Klerelid et al. | 162/111 |
| 2012/0073777 | A1 * | 3/2012 | Klerelid et al. | 162/358.2 |
| 2012/0103550 | A1 * | 5/2012 | Beuther et al. | 162/210 |
| 2012/0267063 | A1 * | 10/2012 | Klerelid et al. | 162/130 |

FOREIGN PATENT DOCUMENTS

| | | | |
|---|---|---|---|
| WO | WO 90/04676 | | 5/1990 |
| WO | WO 9931318 | A1 * | 6/1999 |
| WO | WO 99/49130 | | 9/1999 |
| WO | WO 9949132 | A1 * | 9/1999 |
| WO | WO 03/012197 | A2 | 2/2003 |
| WO | WO 2005/116332 | A1 | 12/2005 |
| WO | WO 2009067066 | A1 * | 5/2009 |
| WO | WO 2009067079 | A1 * | 5/2009 |
| WO | WO 2010033072 | A1 * | 3/2010 |

OTHER PUBLICATIONS

Written Opinion of corresponding international application No. PCT/SE2009/051033, mailed Jan. 28, 2010.

* cited by examiner

TISSUE PAPERMAKING MACHINE AND A METHOD OF MANUFACTURING A TISSUE PAPER WEB

CROSS REFERENCE TO RELATED APPLICATIONS

This application is a national stage application, filed under 35 U.S.C. §371, of International Application No. PCT/SE2009/051033, filed Sep. 16, 2009, which claims priority to Swedish Application No. 0801990-3, filed Sep. 17, 2008 and U.S. Provisional Application No. 61/097,834, filed Sep. 17, 2008, all of which are hereby incorporated by reference in their entirety.

BACKGROUND OF THE INVENTION

1. Field of Invention

The present invention relates to a tissue papermaking machine for manufacturing a tissue paper web, comprising:

a wet section for forming a fibre web, a press section for pressing the fibre web, said press section comprising:

a single press, comprising:

a first press element, a second press element, said press elements forming a press nip therebetween with a predetermined pressure, a press felt running in an endless loop around a plurality of guide rolls and through said press nip together and in contact with the formed fibre web, the second press element being arranged inside the loop of the press felt, a smooth belt running in an endless loop around a plurality of guide rolls and through said press nip together and in contact with the formed fibre web, the first press element being arranged inside the loop of the belt, and a transfer roll arranged inside the loop of the smooth belt, a dry section for final drying of the fibre web pressed in the press nip, said dry section comprising a drying surface for final drying of the pressed fibre web, said transfer roll being arranged to form a transfer nip together with the drying surface for transfer of the fibre web to the drying surface, whereby the smooth belt is arranged to carry the pressed fibre web between the press nip and the transfer nip.

The present invention also relates to a method for manufacturing a tissue paper web in a tissue papermaking machine with higher bulk and softness than what is obtained by a conventional method, said method comprising the steps:

a fibre web is formed and pre-dewatered in a wet section, the fibre web is pressed in a press section, comprising:

a single press, comprising:

a press nip, a press felt running in an endless loop around a plurality of guide rolls and through said press nip together and in contact with the formed fibre web, a smooth belt running in an endless loop around a plurality of guide rolls and through said press nip together and in contact with the formed fibre web, and a transfer roll arranged inside the loop of the smooth belt, the fibre web pressed in the press nip is finally dried in a dry section comprising a drying surface for final drying of the pressed fibre web, wherein the fibre web is transferred to the drying surface by means of a transfer nip formed by the transfer roll and the drying surface, and wherein the pressed fibre web is carried between the press nip and the transfer nip by the smooth belt.

The present invention also relates to a method for reducing the energy consumption in a tissue papermaking machine of the above-mentioned type, and a method of rebuilding a conventional machine. The invention also relates to a use of the smooth belt for manufacturing a relatively high-bulk and very soft, creped tissue paper web.

By conventional tissue paper is meant herein soft paper with a grammage usually under 25 g/m$^2$, e.g., 15-25 g/m$^2$, and bulk from 6 to 8.8 cm$^3$/g depending on the grammage. Tissue paper is the base paper for several single-ply and multiple-ply paper products, such as napkins, hand towels, and rolls of toilet paper, and it has a bulk within the range of 7-10 cm$^3$/g and a softness better than that of conventionally produced tissue paper. Tissue paper which is produced according to the invention has a grammage of 12-42 g/m$^2$, preferably 15-25 g/m$^2$, thickness of 130-240μ, MD strength of 60-500 kN/m, CD strength of 40-250 kN/m and a bulk of 7-10 cm$^3$/g. The pulp used can preferably be a mixture of 70% short fibres and 30% long fibres. The pulp can be "virgin", which is fresh pulp from pure cellulose and a mixture of hardwood pulp and softwood pulp, i.e., short and long fibres. Other types of pulp can also be used, e.g., recycled fibres, in the method and the tissue papermaking machine according to the invention. Different pulps are used for different products. For a pulp for making toilet paper, facial tissue and the like a pulp is used which is a mixture of 50-90% hardwood and 50-10% softwood. For towels, the pulp contains 0-50% hardwood and 100-50% softwood.

By relatively high bulk is meant a bulk of soft paper lying in said range of 7-10 cm$^3$/g. The paper has a thickness lying in the range of 130-240μ, said thickness being measured prior to converting. The softness can be up to 90 on the TSA scale of 0-100.

2. Description of Related Art

FIG. 3 of U.S. Pat. No. 6,743,339 shows a tissue paper machine according to the preamble of claim 1, i.e., where a smooth and essentially impermeable belt runs together with the tissue paper web through the single press in the pressing section of the tissue papermaking machine and further to a transfer nip against a drying surface. The problem with this machine configuration, however, is that it has very bad runability because too much water is entrained with the press felt in the nip and so-called crushing of the tissue fibre web can occur in the press nip. One solution to this problem is to reduce the pressure in the press nip and at the same time compensate for the resulting reduced dewatering by introducing one or more additional press nips in the press section. Such machine configurations are described in FIGS. 1, 2 and 4 of said specification. However, this solution has the drawback of making it hard to create sufficient bulk, i.e., thickness, of the tissue fibre web, since each press nip which the tissue fibre web has to go through negatively affects the bulk by producing more fibre clusters in the web and makes it hard to achieve a final product of requisite quality.

In U.S. Pat. No. 6,287,426 B1 a tissue paper machine is described, comprising a smooth belt that runs in a loop through a press nip and from which the web is transferred to a clothing, which carries the web further to a transfer nip in the drying section.

BRIEF SUMMARY OF THE INVENTION

The object of the present invention is to solve the above problem and provide an improved tissue papermaking machine, in which both good runability and good quality and sufficiently high bulk and softness of the finished tissue paper web are achieved with low energy and investment costs. The invention thus omits the so-called TAD technique as a pre-dryer for removing water from the fibre web in order to increase the dry content between forming section and final dryer. Alternatively, the TAD technique can replace the Yankee cylinder as a final drying unit. In particular, the object of the invention is to provide an alternative, more simple and cheaper tissue papermaking machine using the pressing technique wherein expensive embossing and structuring clothing entirely can be omitted, and sufficient bulk and softness of the web can be achieved at a reasonable price.

The tissue papermaking machine of the invention is characterised in that a pre-dewatering device is arranged upstream of the press to pre-dewater the fibre web to a dry content of preferably 15-30% before the fibre web runs into the press nip of the press, and that the press felt and the smooth belt are arranged to be separated from each other immediately after the exit of the press nip and define therebetween an angle $\alpha$, which is at least 5° in order to prevent rewetting of the pressed fibre web. Said pre-dewatering occurs preferably without compression of the fibre web.

A smooth belt provides a better adhesion to the Yankee cylinder because the fibre web has a larger percentage of its surface evenly formed, which in turn contributes for better adhesion to the drying surface, better more even creping, and higher bulk (thickness about 150μ) and better softness.

By final dryer is meant here drying cylinders, Yankee cylinders, preferably with hood, and possibly TAD roll.

Preferably, the tissue paper web produced in the tissue papermaking machine has higher bulk than that obtained in a conventional tissue papermaking machine. Preferably the fibre web is not compressed either during the pre-dewatering or the transfer to the drying surface, nor is the bulk noticeably affected in said transfer nip. Preferably, said smooth belt is impermeable to water.

According to one embodiment of the tissue papermaking machine, the smooth belt is impermeable to water.

According to another embodiment of the tissue papermaking machine, it has a pre-dewatering device for pre-dewatering of the fibre web to a dry content of 15-30% without compressing.

According to another embodiment of the tissue papermaking machine, it comprises a pre-dewatering device which has a suction device.

According to another embodiment of the tissue papermaking machine, the press is a press with an elongated nip.

According to another embodiment of the tissue papermaking machine, the press is a shoe press.

According to another embodiment of the tissue papermaking machine, the specific pressure in the press nip is 4-6 MPa and the linear load is 400-600 kN/m.

According to another embodiment of the tissue papermaking machine the press is, for grammages of the fibre web in the range of 12-42 g/m$^2$, preferably 15-25 g/m$^2$, designed to dewater the fibre web until the fibre web has a dry content of 46-52% after the press.

According to another embodiment of the tissue papermaking machine, the smooth belt enables a good adhesion of the fibre web against it, whereby the machine speed can be increased to 1300-2200 m/min.

According to another embodiment of the tissue papermaking machine, the press allows for recovery of the thickness of the fibre web at the exit of the press nip, e.g., about 10-20% of the thickness.

According to another embodiment of the tissue papermaking machine, the pre-dewatering device comprises a suction roll, located within the loop of the press felt, and a steam box, located on the outside of the loop of the press felt opposite the suction roll.

According to another embodiment of the tissue papermaking machine, it comprises a preheating device arranged downstream the press to increase the temperature of the fibre web before the fibre web reaches the drying surface.

According to another embodiment of the tissue papermaking machine, when the fibre web after pressing has a dry content of 45-52% before the drying, the energy requirement of the dry section can be reduced by 20-35% as compared to a conventional machine at the same machine speed and same machine dimension or proportionally reduced dimension of final dryer (drying capacity).

Another embodiment of the tissue papermaking machine is characterised in that, when the fibre web has a dry content of 45-52% before the drying, the dimension of the final dryer can be decreased as compared to a conventional machine, for the same machine speed and same energy consumption.

Another embodiment of the tissue papermaking machine is characterised in that, when the fibre web has a dry content of 45-52% before the drying, the machine speed can be increased as compared to a conventional machine, for the same machine dimension and same energy consumption.

The method according to the invention is characterised by the steps:

- the fibre web is dewatered in a pre-dewatering device without compression, said device being arranged upstream of the press, to a dry content of 15-30% before the fibre web runs into the press nip together with the smooth belt, and
- the press felt and the smooth belt are separated from each other immediately after the exit of the press nip, thereby preventing rewetting of the pressed fibre web.

A tissue paper web of relatively high quality and softness is hereby preferably produced. Preferably the smooth belt is impermeable to water or it has low water permeability. Preferably, the web is pre-dewatered upstream the press without significant compression.

According to another embodiment of the method, the press felt and the smooth belt are separated from each other immediately after the exit of the press nip so that the press felt and the smooth belt define between themselves an angle $\alpha$, which is at least 5°.

According to another embodiment of the method, the tissue paper web is produced at a machine speed in the range of 1300-2200 m/min.

According to another embodiment of the method, the fibre web is dewatered in a pre-dewatering device to a dry content of 15-30% before the fibre web enters the press nip of the press so that the fibre web obtains a dry content of 45-52% after the press thus reducing the energy requirement for the final drying of the fibre web on the drying surface.

According to another embodiment of the method, said energy requirement is 20-35% less than corresponding energy requirement of a conventional tissue papermaking machine at the same speed.

The method for rebuilding a conventional machine into a machine for production of tissue paper of higher bulk and softness involves the step of replacing a conventional press felt with a smooth belt between a last press and a final dryer of the machine. The smooth belt is in this case preferably substantially impermeable to water and consists of at least one of the materials metal, polymer and polyurethane, which is woven or extruded.

BRIEF DESCRIPTION OF THE FIGURES

The invention will be described further in the following with reference to the drawings.

DETAILED DESCRIPTION OF VARIOUS EMBODIMENTS OF THE INVENTION

Figure 1:
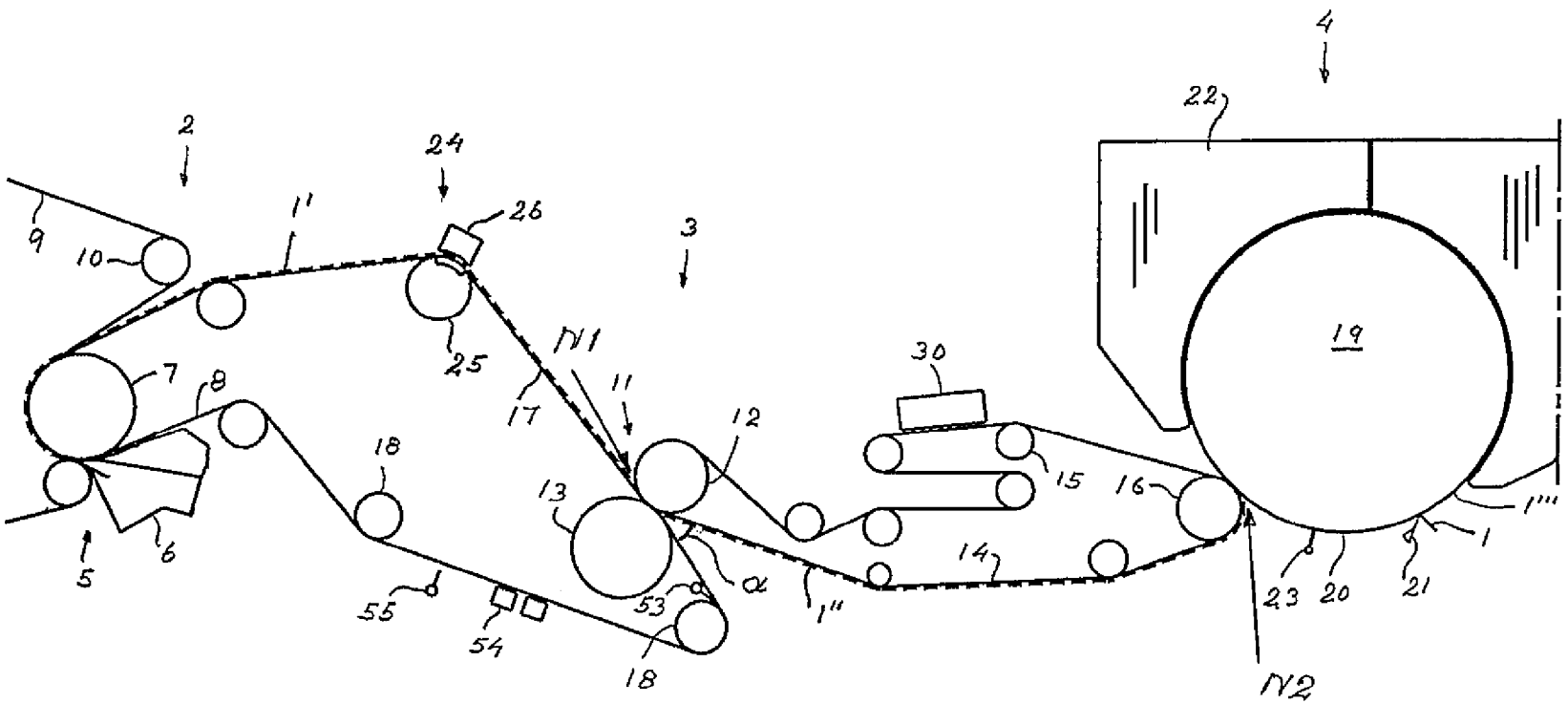
FIG. 1 shows a tissue papermaking machine according to a first embodiment of the invention.
Figure 2:
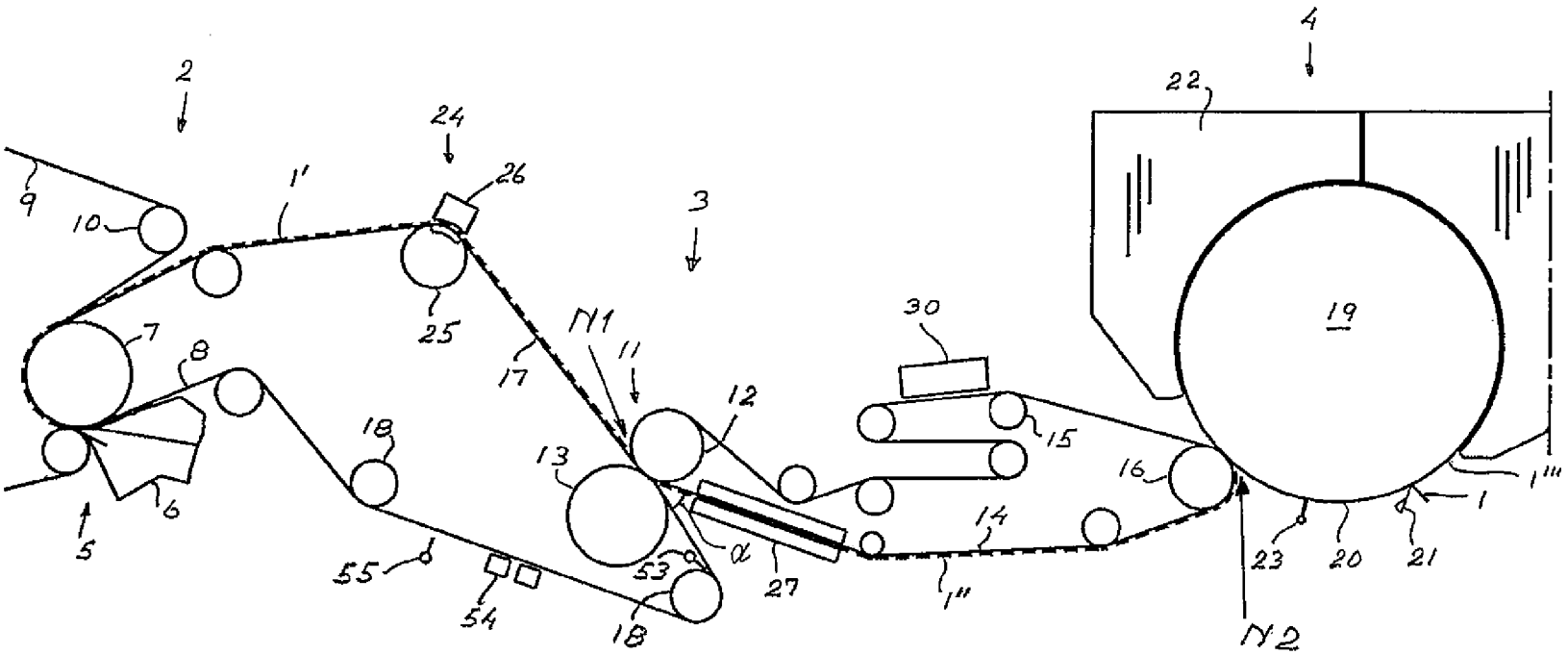
FIG. 2 shows a tissue papermaking machine according to a second embodiment of the invention.

In FIGS. 1 and 2, different embodiments are shown schematically of a tissue papermaking machine for producing a tissue paper web 1 without the use of through air drying (TAD) for dewatering in accordance with the present invention. A common feature of the different embodiments is that they comprise a wet section 2, where the paper web is formed, a press section 3 for dewatering to increase the dry content of the web before the final drying, and a dry section 4. The wet section 2 of each tissue papermaking machine according to the shown embodiments comprises a double-wire former 5 which comprises a headbox 6, a forming roll 7 and a first forming clothing 8, which runs around and in contact with the forming roll 7. The former 5 also comprises a second forming clothing 9, which is a fabric that runs in an endless loop around a plurality of guide rolls 10 and around the forming roll 7 in contact with the first clothing 8 to receive a stock jet from the headbox 6 between itself and the first clothing, after which the stock is dewatered most through the clothing 9 to form a formed fibre web 1'. A high-pressure water sprayer (needle sprayer) 55 (with a pressure up to 20 bar) comprising one or more traversing needle-nozzle pipes with diameter of 1 mm is arranged to traverse on the outside of the forming clothing 8 upstream of the forming roll 7 to clean the forming felt 8.

The press section 3 comprises a press 11, which comprises a first press element 12 and a second press element 13 cooperating with each other to form a press nip therebetween. Moreover, the press section 3 comprises a smooth belt 14 running in an endless loop about a plurality of guide rolls 15, around a smooth transfer roll 16, located adjacent to the dry section 4, which comprises a drying cylinder 19 for final drying of the web 1', and through the press nip of the press 11 together and in contact with the formed fibre web 1' to dewater the formed fibre web 1' when this runs through the press nip N1, so that a dewatered fibre web 1" will leave the press nip N1. The fibre web 1" is carried by the belt 14 up to and through the transfer nip N2 between the transfer roll 16 and the drying cylinder 19, in which nip N2 preferably no pressing or dewatering takes place, but only a transfer of the fibre web 1" to the surface 20 of the drying cylinder 19. Moreover, the press section 3 comprises a water-receiving press felt 17 which is elastically deformable and compressible in the z-direction, running in an endless loop around a plurality of guide rolls 18 and through the press nip N1 of the press 11 together with the belt 14 and in contact with the formed fibre web 1'. The first press element 12 is located in the loop of the belt 14, and the second press element 13 is located in the loop of the second press felt 17. In the embodiments shown in FIGS. 1 and 2, both press elements 12, 13 are press rolls. Alternatively to conventional press rolls, rolls forming a long nip can be used, such as shoe press rolls and other types of presses with long nip. The press felt 17 leaves the fibre web 1" immediately after having run through the press nip N1 in order to avoid rewetting of the fibre web 1".

This is important, since otherwise the press felt 17 may rewet the fibre web 1".

To ensure the adhesion of the fibre web 1" and ensure excellent runability of the machine, the belt 14 is preferably impermeable to water. However, a certain slight permeability to water can be allowed under various operating conditions. For example, the belt 14 can be of the type described in the previously mentioned document U.S. Pat. No. 6,743,339, i.e. it can comprise an outer layer having a hardness in the range of 50-97 Shore A, and a surface roughness in the uncompressed state in the interval $R_z$=2-80 μm (measured according to ISO 4287, part I) and a surface roughness in the compressed state in the interval $R_z$=0-20 μm (for an applied linear load of 20-200 kN/m). The belt 14 consists preferably of a suitable plastic material, such as polyurethane.

Other types of smooth belt with smooth web-contacting surface, such as a metal belt or composite belt, can be used alternatively.

In the embodiments according to FIGS. 1 and 2, the press felt 17 is utilized also as the first, inner forming clothing 8 of the former 5, so that the forming roll 7 is also located inside the loop of the press felt 17. The former 5 can consequently be a so-called C-former, as shown in FIGS. 1 and 2, but it can alternatively be of a different type, such as a so-called Cresent former.

Just before the first guide roll 18 after the press 11, a spray nozzle 53 is arranged on the inside of the press felt 17 to supply pure water into the wedge-formed tapering space between the press felt 17 and the guide roll 18, said water being forced into the press felt 17 and displaces the contaminated water present in the press felt 17 after the pressing in the press 11, through and out from the press felt 17 as it runs around the guide roll 18. Upstream of the next guide roll 18 there are suction boxes 54 arranged on the outside of the press felt to suction away water from the press felt before it arrives at the wet section 2.

After the belt 14 has left the transfer roll 16 and before reaching the press 11, the belt 14 runs through a cleaning station 30 to clean the surface of the belt 14 which is in contact with the fibre web 1'.

The dry section 4 comprises at least one drying cylinder 19 which in the embodiments shown is the only drying cylinder that advantageously is a Yankee drying cylinder. Other alternative embodiments of the dry section can be used, such as conventional drying cylinders or drying by means of metal belts. The drying cylinder 19, with which the transfer roll 16 forms a transfer nip N2, has a drying surface 20 for drying the fibre web 1". A creping doctor 21 is placed at a downstream position from the drying surface 20 to crepe off the dried fibre web 1'" from the drying surface 20 to obtain the tissue paper web 1 which is finally dried and creped. The drying cylinder 19 is covered by a hood 21. The mentioned transfer roll 16 and drying cylinder 20 form a transfer nip N2 therebetween through which transfer nip N2 the belt 14 and the fibre web 1" dewatered to 45-52% dry content run together, but leave the transfer nip N2 separately, since the fibre web 1" adheres to and is transferred to the drying surface 20 of the drying cylinder 19. The linear load in the transfer nip N2 formed by the roll 16 and the drying cylinder 19 is preferably 30-60 kN/m and is such that no dewatering or compression of the web occurs in this nip. To ensure that the fibre web 1" is transferred to the drying surface 20, a suitable adhesive is applied by means of a spray device 23 to the drying surface 20 at a place between the creping doctor 21 and the transfer nip N2 where the drying surface 20 is free. In alternative embodiments, the linear load in the transfer nip can be reduced to 10 kN/m.

The press 11 can be a roll press where the two press elements 12, 13 are rolls with smooth envelope surfaces, or, which is preferable, a long nip press of various configurations, e.g., a shoe press, where the first press element 12 is a smooth counter roll and the second press element 13 comprises a press shoe and an endless belt running through the press nip of the shoe press in sliding contact with the press shoe which exerts a predetermined pressure against the inside of the belt and against the counter roll 12. Thus, the press shoe is a device that forms an extended press nip. In the case wherein the press 11 is a shoe press, the maximum pressure of the press 11 is preferably about 4-6 MPa and its linear load is preferably about 400-600 kN/m. In a further preferred embodiment of the press 11, the first press element 12 is a smooth counter roll and the second press element comprises a device to form an extended press nip, said devices comprising an elastic support body arranged to press in a direction to the counter roll. In an alternative embodiment, the press element 13 is a smooth counter roll, while the second press element 12 comprises a device forming an extended nip of the type mentioned above.

The press 11 thus constitutes the only press of the press section 3, resulting in a simple, cheap and reliable machine configuration. However, since the press 11 is the only press, the pressure in the press 11 can be relatively high to achieve sufficiently high dry content of the fibre web 1" when it is transferred to the drying surface 20 and a sufficient number of bonds are formed between the fibres in the fibre web 1" so that the web 1" has sufficient strength. The provision of a sufficient number of fibre bonds in the filter web 1" in the press nip N1 in such embodiments of the machine drastically reduce the need to grind the fibres in a mill and in this way the energy consumption of the machine is also lowered. Preferably, the fibre web 1" has a dry content in the range 45-52% when it is transferred to the drying surface 20.

The embodiment according to FIG. 2 is similar to that in FIG. 1 except that it is furthermore supplemented with a preheating device 27 downstream of the press 11 to raise the temperature of the fibre web 1" before the fibre web 1" reaches the drying cylinder 19. The web is creped off from the drying surface which has a temperature of between 85° C. and 110° C.

According to the invention, the tissue papermaking machine comprises a pre-dewatering suction device 24 located upstream of the press 11 in order to dewater the fibre web 1' so that it obtains sufficiently high dry content up to 15-30% when it enters the press 11. If the fibre web 1' does not obtain sufficiently high dry content before entering the press 11 and the press felt 17 entrains too much water into the nip N1, there is a risk that the fibre web 1' will be damaged, and in the worst case so-called crushing occurs in the press nip N1 of the press 11 in which case there is a risk that the fibre web 1' will be ruptured. In the embodiments according to FIGS. 1 and 2, the pre-dewatering suction device 24 comprises a suction roll 25 (or similar known conventional devices with vacuum of 30-50 kPa) located inside the loop of the press felt 17, and a steam box 26 with a capacity of 0.1-0.8 ton steam per ton of paper, located on the outside of the loop of the press felt 17 opposite the suction roll 25 to heat the water in the formed fibre web V. Alternatively, other dewatering devices known in the art can be used. By means of such a suction roll 25 and steam box 26, the quantity of water is reduced in the formed fibre web 1' and in the press felt 17 so that the dry content of the fibre web 1' is increased from 8-12% to 20-25% or even up to 30%, so that the formed fibre web 1' obtains a desirably increased dry content before the press 11 and the water content in the filter is reduced to achieve an effective dewatering in the press 11. In the machine configurations shown in FIGS. 1 and 2, the dry content of the fibre web 1' should be at least about 15-30% when the fibre web 1' runs into the nip N1. The 25 suction roll of the pre-dewatering device 24 should increase this dry content so that it is preferably at least about 20-30% when the fibre web 1' enters the press 11. In the machine configuration shown, the pre-dewatering device comprises a suction roll 25 and a steam box 26 arranged in the wet section 2 along the path of the fibre web 1' between the former 5 and the press section 3. It is to be understood that other pre-dewatering devices, for instance suction boxes, can be used to give the fibre web 1' the required dry content before it enters the press 11.

In order to achieve sufficiently high dry content of the fibre web 1" after the press 11, the specific pressure in the press is preferably 4-6 MPa and the linear load is preferably 400-600 kN/m. For a specific pressure of 6 MPa, it is obtained for grammages of the fibre web 1" in the range of 16-25 g/m$^2$ a dry content 46-52% after the press 11. The reason for the high dry content in the tissue papermaking machine according to the invention is that no or very low amount of water is conveyed from the fibre web 1" to the belt 14 in the press nip N1 of the press 11 and that all the water is carried away by the press felt 17, and that essentially no rewetting of the fibre web 1" occurs between the press 11 and the transfer roll 16, since the press felt 17 and the belt 14 are separated from each other immediately after the exit of the nip N1. The rewetting prevented is a result of the facts that the fibre web 1" is carried to the transfer roll 16 by the smooth belt 14, which does not absorb water, and that the press felt 17 leaves the fibre web 1' immediately after the press nip of the press 11. There is also a further result of this, namely that the web 1" can expand in the z-direction and partly resume its bulk or thickness, e.g., about 10-20% of the thickness, before reaching the transfer nip N2 and in this way maintain the relatively high bulk.

The relatively high dry content of the fibre web 1" after running through the press 11 and the fact that the smooth belt 14 does not rewet the fibre web 1" means that dewatering of the fibre web 1" in the transfer nip N2 between the transfer roll 16 and the drying cylinder 19 is not necessary. This is an advantage, since a lower or low linear load, which then can be used in the transfer, means that the thickness of the fibre web 1" is to a great extend maintained as the fibre web 1" runs through the transfer nip N2 and the fibre web 1" is not further compressed. As mentioned above, the linear load in the transfer nip is preferably 30-50 kN/m. A reduced linear load in the transfer nip N2 furthermore contributes to a more simple and cheaper construction of both the transfer roll and the Yankee cylinder, which latter then no longer needs to bear large loads, and one also avoids deformations of the drying surface, the need for cambering of a drying cylinder, or essentially the sensitivity of cambering problems will be less, and better running performance is achieved. This, in turn, influences the creping process in a favourable way, so that a more even moisture and grammage profile of the web and more even creping and more even thickness for the paper itself are obtained.

Thanks to the high dry content of the fibre web 1" after running through the press section 3, the energy requirement for the final drying of the fibre web 1" on the drying surface 20 becomes 20-30% lower than corresponding energy requirement in a conventional tissue papermaking machine at the same machine speed and same machine size. Alternatively, the dimensions of the Yankee cylinder can be reduced for the same machine speed and same energy consumption. For the same machine and same energy consumption, the machine speed (production capacity) can be increased proportionally.

The good adherence of the fibre web 1", provided by the smooth belt—due to the fact that the fibre web has a higher percentage of smooth formed surface that will be in contact with the surface of the Yankee cylinder in the transfer, i.e., the fibre web has a more uniform thickness as seen in cross section (the z-direction)—results in a better runability of the tissue papermaking machine without web rupture. This makes it possible to increase the machine speed up to 1300-2200 m/min. Moreover, the high adhesion of the fibre web 1" to the drying surface results in an improved creping result, i.e., softness, of the creped paper and of the final product, and enables that a subsequent calendering to improve the softness can be avoided. The fibre web, which is more evenly creped, gives a better feeling of softness, i.e., it has higher quality of the product at a lower energy consumption as compared to tissue paper manufactured in conventional machines.

The invention claimed is:

1. A tissue papermaking machine for manufacturing a tissue paper web (1"), comprising:

a wet section (2) for forming a fibre web (1'), a press section (3) for pressing the fibre web (1'), said press section (3) comprising:

a single press (11), comprising:

a first press element (12), a second press element (13), said press elements (12, 13) forming a press nip (N1) therebetween with a predetermined pressure, a press felt (17) running in an endless loop around a plurality of guide rolls (18) and through said press nip (N1) together and in contact with the formed fibre web (1'), the second press element (13) being arranged inside the loop of the press felt (17), a smooth belt (14) running in an endless loop around a plurality of guide rolls (15) and through said press nip (N1) together and in contact with the formed fibre web (1'), the first press element (12) being arranged inside the loop of the belt (14), and a transfer roll (16) arranged inside the loop of the smooth belt (14), a dry section (4) for final drying of the fibre web (1") pressed in the press nip (N1), said dry section (4) comprising a drying surface (20) for final drying of the pressed fibre web (1"), said transfer roll (16) being arranged to form a transfer nip (N2) together with the drying surface (20) for transfer of the fibre web (1") to the drying surface (20), whereby the smooth belt (14) is arranged to carry the pressed fibre web (1") between the press nip (N1) and the transfer nip (N2), wherein:

a pre-dewatering device (25) is arranged substantially adjacent the press felt (17) at a location upstream of and spaced apart from the first press element (12) and the second press element (13) of the press (11), and prior to any contact between the fibre web (1") and the smooth belt (14), the pre-dewatering device (25) being configured to pre-dewater the fibre web (1') to a dry content of 15-30% before the fibre web (1') runs into the press nip (N1) of the press (11); and the press felt (17) and the smooth belt (14) are arranged to be separated from each other immediately after the exit of the press nip (N1) and define therebetween an angle $\alpha$, which is at least 5° in order to prevent rewetting of the pressed fibre web (1").

2. The tissue papermaking machine according to claim 1, wherein the smooth belt (14) is impermeable to water.

3. The tissue papermaking machine according to claim 1, further comprising a pre-dewatering device (25) for pre-dewatering of the fibre web (1') to a dry content of 15-30% without compressing.

4. The tissue papermaking machine according to claim 1, further comprising a pre-dewatering device (25) which has a suction device.

5. The tissue papermaking machine according to claim 1, wherein the press (11) is a press with an extended nip.

6. The tissue papermaking machine according to claim 5, wherein the press (11) is a shoe press.

7. The tissue papermaking machine according to claim 1, wherein the specific pressure in the press nip (N1) is 4-6 MPa and the linear load is 400-600 kN/m.

8. The tissue papermaking machine according to claim 7, wherein, for grammages of the fibre web (1") in the range of 12-42 g/m$^2$ the press is arranged to dewater the fibre web (1") so that the fibre web (1") obtains a dry content of 46-52% after the press (11).

9. The tissue papermaking machine according to claim 7, wherein, for grammages of the fibre web (1") in the range of 15-25 g/m$^2$, the press is arranged to dewater the fibre web (1") so that the fibre web (1") obtains a dry content of 46-52% after the press (11).

10. The tissue papermaking machine according to claim 1, wherein the smooth belt (14) provides an adhesion of the fibre web (1") against it whereby the machine speed can be increased to 1300-2200 m/min.

11. The tissue papermaking machine according to claim 1, wherein the press (11) provides a recovery of the thickness of the fibre web (1") at the exit of the press nip (N1).

12. The tissue papermaking machine according to claim 1, wherein the pre-dewatering device (19) comprises a suction roll (25) located within the loop of the press felt (17), and a steam box (26) located on the outside of the loop of the press felt (17) opposite the suction roll (25).

13. The tissue papermaking machine according claim 1, further comprising a preheating device (27) arranged downstream of the press (11) to increase the temperature of the fibre web (1") before the fibre web (1") reaches the drying surface (20).

* * * * *

UNITED STATES PATENT AND TRADEMARK OFFICE

CERTIFICATE OF CORRECTION

PATENT NO. : 8,414,741 B2
APPLICATION NO. : 13/063700
DATED : April 9, 2013
INVENTOR(S) : Klerelid et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 13 days.

Signed and Sealed this
First Day of September, 2015

Michelle K. Lee

Michelle K. Lee
*Director of the United States Patent and Trademark Office*